US005522586A

United States Patent [19]

Bennett et al.

[11] Patent Number: 5,522,586

[45] Date of Patent: Jun. 4, 1996

[54] FOLDING APPARATUS WITH MULTIPLE SPEED FOLDING JAW CYLINDER

[75] Inventors: Robert M. Bennett; Ian Douglas, both of Peterborough, England

[73] Assignee: Rockwell International Corporation, Seal Beach, Calif.

[21] Appl. No.: 301,822

[22] Filed: Sep. 7, 1994

[51] Int. Cl.[6] ..... B41F 13/58; B31F 1/08; B31B 1/26

[52] U.S. Cl. ..... 270/8; 270/21.1; 493/429; 493/432; 493/458

[58] Field of Search ..... 270/8, 9, 20.1, 270/42, 4, 5, 6, 41, 49, 50, 21.1; 493/425, 426, 427, 428, 429, 432, 458

[56] References Cited

U.S. PATENT DOCUMENTS

| | | | |
|---|---|---|---|
| 3,784,187 | 1/1974 | Takayanagi et al. | 270/6 X |
| 4,159,823 | 7/1979 | Bryer et al. | 493/425 X |
| 4,332,582 | 6/1982 | Hertrich | 493/432 X |
| 4,391,596 | 7/1983 | Fischer | 493/425 |
| 5,078,374 | 1/1992 | Odeau | 270/6 X |
| 5,088,708 | 2/1992 | Nowak | 493/432 X |
| 5,096,174 | 3/1992 | Nishihara | 270/49 X |
| 5,201,701 | 4/1993 | Roettger et al. | 493/425 |
| 5,242,367 | 9/1993 | Marmin | 493/429 X |
| 5,386,979 | 2/1995 | Muller | 270/42 |
| 5,443,437 | 8/1995 | Mack | 493/429 X |

FOREIGN PATENT DOCUMENTS

| | | | |
|---|---|---|---|
| 2407575 | 8/1975 | Germany | 493/429 |
| 48157 | 4/1980 | Japan | 270/8 |
| 295374 | 12/1988 | Japan | 270/21.1 |
| 192669 | 8/1989 | Japan | 270/20.1 |
| 413874 | 12/1966 | Switzerland | 493/429 |

*Primary Examiner*—John E. Ryznic
*Attorney, Agent, or Firm*—C. B. Patti; G. A. Montayne

[57] ABSTRACT

Continuous web-fed rotary tuck and jaw type folding apparatus, typically for high speed periodical, catalogue or newspaper production, is speedily and readily convertible to produce differently page sized and differently folded signatures. Said apparatus has severing means for cutting the web into a stream of discrete signatures; a first rotary cylinder having pin or other transport means and first tuck means carrying those signatures on its periphery, a second rotary cylinder having first or main jaw means coacting with said first tuck means whereby a central cross fold is created in each signature as it is taken off the first cylinder periphery onto the second cylinder periphery to provide a tabloid format signature; and one or more third cylinders each provided with independently operable sets of gripper and second jaw means, the gripper means operating with the third cylinder running in timed relationship so that they take off said tabloid folded signatures for onward transmission, and the second jaw means operating with the third cylinder running in timed relationship to second tucking means of the second cylinder so as to form a further central cross fold in each tabloid signature as it is taken off the second cylinder periphery to provide a double-parallel folded signature.

5 Claims, 6 Drawing Sheets

4 ROUND CYLINDER X 0.75
CIRCUMFERENCE = 4 X CUT-OFF X 0.75
= 3 X CUT-OFF

CYLINDER IS ALSO 3 ROUND WITHOUT SLOW-DOWN

FOR TABLOID & 1/4 PAGE - CYL. MAKES 1/4 REV. PER COPY
FOR DOUBLE PARALLEL - CYL. MAKES 1/3 REV. PER COPY

PRINCIPLE OF DUAL PURPOSE GRIPPER / D.P. JAW CYL

FOLDING APPARATUS WITH MULTIPLE SPEED FOLDING JAW CYLINDER

This invention relates to continuous web fed rotary tuck and jaw type folding apparatus, particularly for high speed large capacity automated operation at the output end of printing or other processing plant, typically for production of periodicals, catalogues and newspapers.

More specifically the invention relates to a dual or multi-purpose folding apparatus of the above type enabling production of folded signatures of different page sizes and formats from continuous web infeed in a particularly speedy and reliable manner, and with simple and quick change over from one format to another.

The invention provides folding apparatus which has severing means for cutting the web into a stream of discrete signatures; a first rotary cylinder having pin or other transport means and first tuck means carrying those signatures on its periphery, a second rotary cylinder having first or main jaw means coacting with said first tuck means whereby a central cross fold is created in each signature as it is taken off the first cylinder periphery onto the second cylinder periphery to provide a tabloid format signature; and one or more third cylinders each provided with independently operable sets of gripping and second jaw means, the gripper means operating with the third cylinder running in timed relationship so that they take off said tabloid folded signatures for onward transmission, and the second jaw means operating with the third cylinder running in timed relationship to second tucking means of the second cylinder so as to form a further central cross fold in each tabloid signature as it is taken off the second cylinder periphery to provide a double-parallel folded signature.

It is known to provide rotary tuck and jaw double parallel folding supplementing tabloid or like prior folding either of two ways. Firstly by the use of a secondary cylinder positioned in the same way as an above mentioned third cylinder to coact with a main cylinder feeding tabloid format signature, said secondary cylinder being provided with tucking blades coacting with extra sets of jaws on the main cylinder. Operation of this first known apparatus involves transfer of signatures onto the secondary cylinder and then back onto the main cylinder to effect double parallel folding, this double transfer giving rise to problems as to reliability and maintenance of register, and necessitating a further cylinder or other transfer arrangement for subsequent removal of double parallel signatures from the main cylinder. Secondly double parallel folding has been provided by feeding the tabloid or other prior folded signatures between a pair of coacting additional jaw and tucking cylinders after leaving the main cylinder, again giving rise to difficulties over maintaining register adding to the complexity and cost of the apparatus.

The invention does not require the use of these additional cylinders or transfer facilities so simplifying construction and operation, rendering change over between modes and monitoring and adjustment of operation more simple, and leaving room for other facilities, e.g. the ready provision of dual stream output from a main cylinder as referred to hereafter.

While each or all of the first, second and third cylinders of the invention could be dimensioned to handle only one signature at a time so that they would be respectively provided with a single first tucking element, a single first jaw means and single second tucking element, and a single gripper and second jaw means it is preferred that they are sized to carry several successive signatures acted on in turn by multiple tucking elements and jaw means.

Also a single third cylinder may be used for some applications but it is preferred that two such cylinders are provided, coacting with respective peripheral zones of a larger diameter second cylinder so that two output streams of signatures are formed.

A preferred embodiment of the invention is now more particularly described with reference to the accompanying drawings, wherein.

Figure 1:
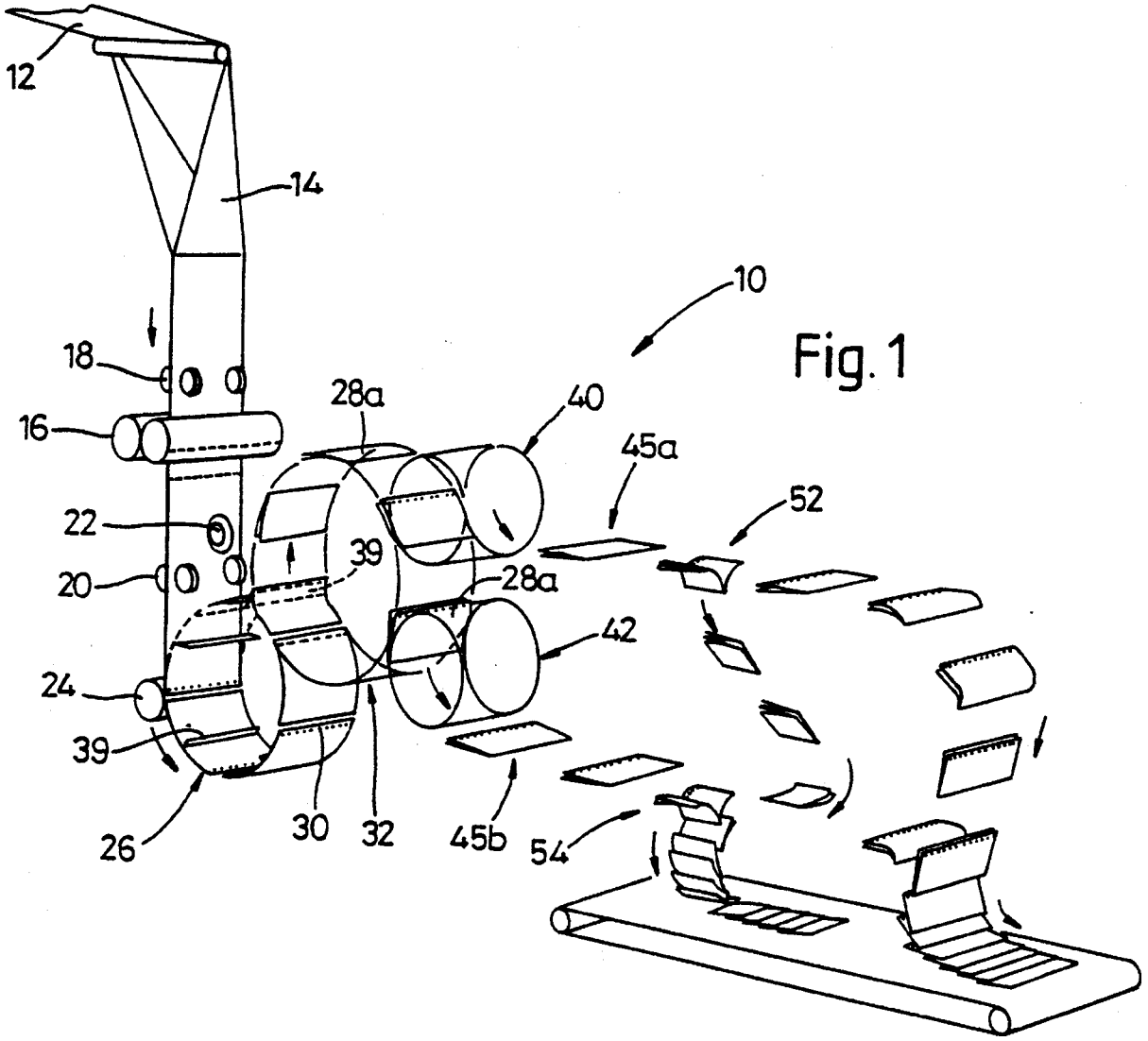
FIG. 1 is a schematic overall diagram of the preferred folding apparatus.

Referring firstly to FIG. 1 the folding apparatus is an operative part of a continuous web processing installation, typically for high speed periodical, catalogue or newspaper production, comprising a series of rotary offset or other colour printing units of known construction and therefore not shown in the drawings which print both sides of the web. The web then passes through a dryer to set the ink and over chill rolls to cool the web (also of conventional construction and not shown in the drawings) before entering the folding apparatus 10 now described which cuts and folds the web to form a series of discrete signatures.

It is to be understood that the continuous web, as it enters the folding apparatus, may consist of a single length of web material folded lengthwise or not or two or more superimposed lengths, i.e. the term "web" is used herein to apply to one or more continuous co-extensive lengths of paper or other materials; also that the term "signature" is used herein to mean a single sheet or a plurality of superimposed sheets whether unfolded or folded one or more times.

Apparatus 10 is a combination apparatus adapted to deliver broadsheet signatures with tabloid convenience fold (4 pages per web), tabloid signatures (8 pages per web), double-parallel signatures (16 pages often printed two-up) and quarter-page signatures (16 pages per web).

Typically the printed web 12 first passes downwards through a former board 14 which is triangular in shape with its apex, the former nose, pointing downwardly so that the side edges of web 12 are brought together to form a longitudinal central fold therein, or with the addition of longitudinal center slitting, two superimposed webs. For some applications this first folding and or slitting may be omitted.

The web then passes through a rotary cross perforator 16 which perforates across the web width in known manner at positions which will coincide with the later first cross fold (tabloid fold). The perforation is designed to assist the subsequent folding processes by and prevent gusseting on the inside pages where a "chopped" fold meets the tabloid fold.

Roll nips 18 and 20 respectively on the downstream sides of former board 14 and perforator 16 assist in guiding and controlling passage of the web through those elements and feeding it onwards. There is also a rotary creaser 22 downstream of perforator 16 which operates in known manner to put a continuous longitudinal crease along web 12 positioned to line up with subsequent quarter page folding, so as to assist in formation of that fold.

Below, i.e. downstream, of lower roll nip 20 is a conventional knife cylinder 24 across one face of web 12 coacting with a larger diameter pin and tuck cylinder 26 across the opposite face. Knife cylinder 24 determines the length of the portions into which the web is severed at the first stage in forming the individual signatures, the length being identical to or half of the unit plate cylinder circumference of the printing units. The cut off is made by a blade in the knife cylinder that cuts through web 12 into a resist across the width of the pin and tuck cylinder 26. The latter cylinder also has rows of sharp pins 30 across it as well known in the art which pierce the leading edge of the web, drawing it round that cylinder, positioned to synchronise with the action of the knife cylinder 24 to cut the trailing or tail part of the web drawn by the pins to length as stated above. The severed lengths 28 constitute first stage signatures and are carried round on the periphery of cylinder 26 by their engagement with the pins 30 to pass into a nip between that periphery and the periphery of a main jaw cylinder 32. However, the invention may also be applicable to pinless folders having other provision for signature transport.

If tabloid format is required, signatures 28 are folded crosswise (tabloid fold) by coaction between pin and tuck cylinder 26 and main jaw cylinder 32, at the same time transferring the signatures from the former to the latter.

Figure 2:
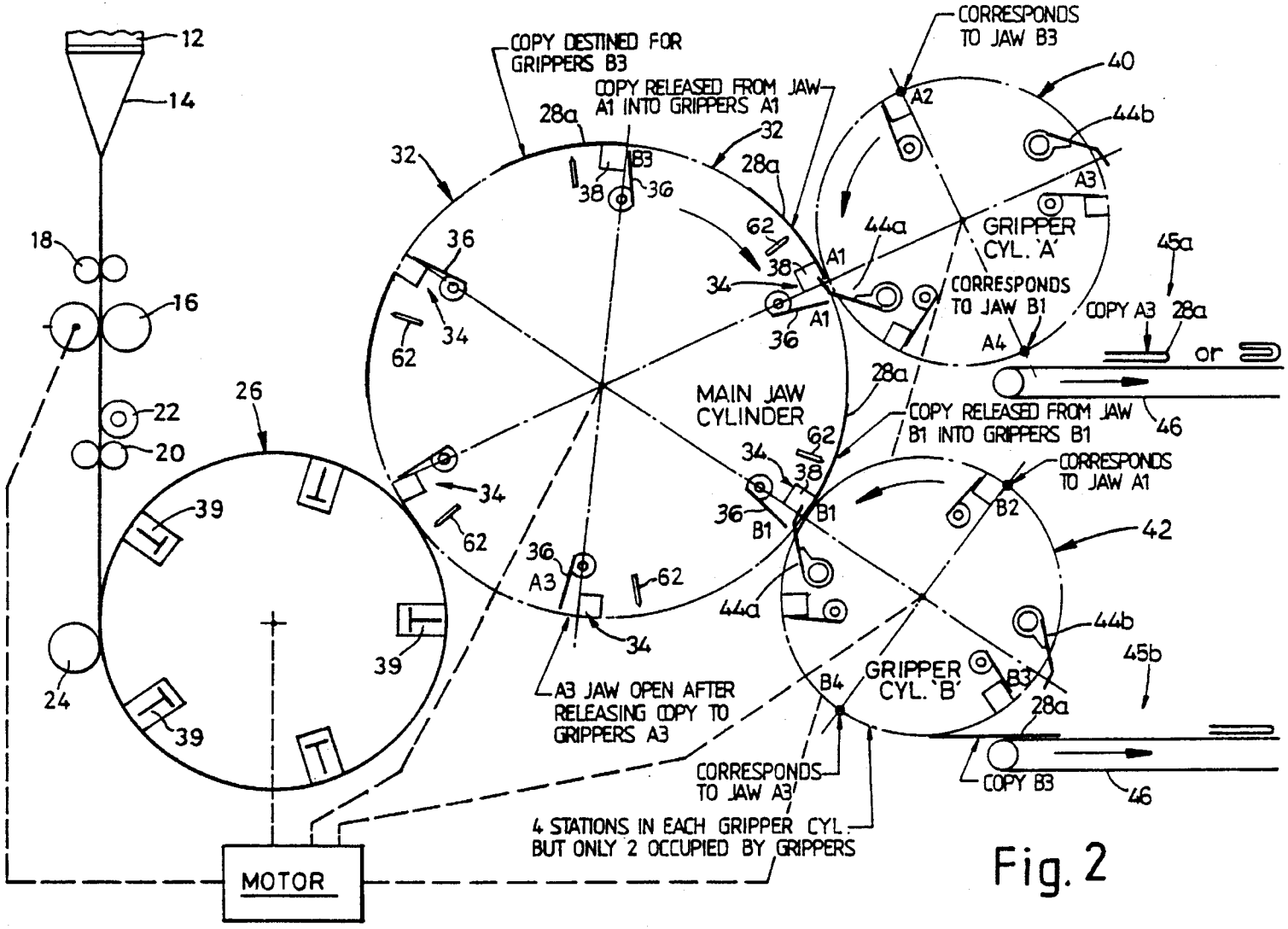
FIG. 2 is a diagrammatic and elevation of jaw and gripper cylinders of the apparatus.

Cylinder 32 is shown in somewhat greater detail in FIG. 2. It has six equi-angularly spaced cam operated sets of tabloid jaws 34 across its periphery, each set of jaws comprising a cam actuated jaw blade 36 and a coacting jaw anvil 38.

Pin and tuck cylinder 26 includes cam operated tucker blades 39 of conventional type, indicated diagrammatically in FIG. 1, angularly positioned to operate in timed relationship with the operation of tabloid jaws 34 of cylinder 32. Each tucker blade 39 inserts the centre of signature 28 between the jaw blade 36 and jaw anvil 38 of a respective set of tabloid jaws 34 on cylinder 32 so that a cross fold is formed and at the same time the signature is transferred to the latter cylinder by being gripped by jaws 34, the second folded (tabloid) signatures being indicated at 28*a* in FIGS. 1 and 2.

Main jaw cylinder 32 coacts in turn with upper and lower gripper cylinders 40,42, each gripper cylinder taking alternate signatures from main jaw cylinder 32, i.e. the output from the latter is separated into upper and lower streams indicated at 45*a* and 45*b* in FIG. 1.

The construction and action of gripper cylinders 40 and 42 is identical and the subsequent description relating to upper cylinder 40 is also to be taken as relating to lower cylinder 42. For some applications, where only single stream output is required, only a single gripper cylinder need be provided.

If tabloid output from those cylinders is required, take-off grippers 44*a*, 44*b* (FIG. 2), cam operated in timed relationship to the motion and opening of the tabloid jaws 34 of main jaw cylinder 32, engage and remove the tabloid folded signatures 28*a* to release them onto transport tapes 46 (FIG. 2) which carry the two streams away for further processing and/or bundling and packing. For example said tabloid signatures 28*a* may be further processed by quarter page folding indicated at 52,54 in FIG. 1 using chopper action folding apparatus as described in pending U.S. patent application Ser. No. 281,247, filed Jul. 27, 1994, incorporated herein by reference, to which reference is made for further description thereof.

For some applications it is desirable to form signatures having a further centre fold in the above tabloid format i.e. an additional fold crosswise of the direction of travel of such signatures over the peripheries of the above cylinders, referred to as a "double parallel" (or digest) folded signature as the further fold is parallel to the tabloid fold itself.

Figure 3:
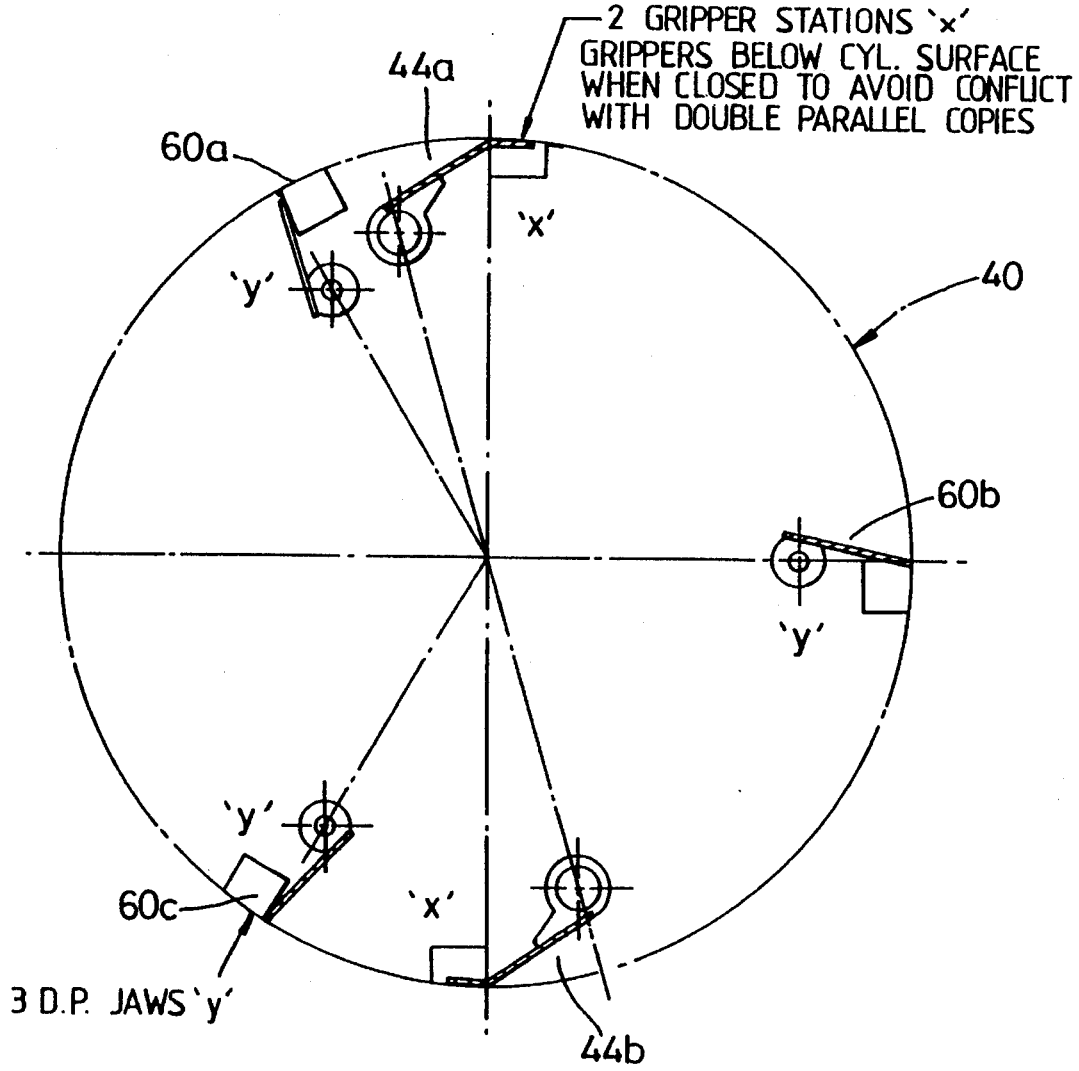
FIG. 3 is a like end elevation showing further detail of one gripper cylinder.

To achieve this dual function, gripper cylinder 40 is also provided with three sets of cam actuated double parallel (d.p.) jaws 60*a*, *b* and *c* (FIG. 3) and of similar construction and operation to the sets of tabloid jaws 34 of main jaw cylinder 32. D.p. jaws 60 are spaced equiangularly about the periphery of cylinder 40 i.e. at 120° spacing disposed so that their positioning does not coincide with or overlap the positioning of the two diametrally opposite take-off grippers 44*a*, 44*b*. The cam operated engaging elements of the latter grippers are shaped so that they lie flush with or below the cylinder periphery when closed, thus when inoperative they do not interfere with the action of the sets of d.p. jaws 60, and their cam operation is independent of the latter i.e. when grippers 60 are operative jaws 44 remain inoperative and vice versa.

Main jaw cylinder 32 is provided with cam operated radially extendable tucking blades 62 shown diagrammatically in FIG. 2 and again which can be held selectively inoperable. They are angularly positioned to act on the centre line of each tabloid folded signature 28*a* carried on the periphery of cylinder 32.

In d.p. mode gripper cylinders 40 will run without slow down at 6:3 ratio to main jaw cylinder 32, the latter cylinder accommodating six cut offs around its periphery and the smaller gripper cylinder accommodating three cut offs around its periphery represented by the three sets of d.p. jaws 60.

In tabloid mode gripper cylinder 40 is run with 25% slow down, i.e. at 6:4 ratio to main cylinder 32, because cylinder 40 accommodates, in theory, four signatures around its periphery. In practice there are only take-off grippers 44 at alternate 90° locations, hence spaced at 180° from each other so that each respective cylinder 40, 42 takes-off only every alternate tabloid signature from cylinder 32.

So in tabloid mode cylinder 40 makes one quarter revolution per cut off i.e. per copy fed by the periphery of main cylinder 32; and in d.p. mode cylinder 40 makes one third revolution per cut off.

When double parallel folding is required apparatus 10 can be speedily changed over from the tabloid format to give this facility. Cams of main jaw cylinder 32 are set to bring tucking blades 62 into operation in timed relationship to gripper cylinders 40 and 42 and the relative speed of rotation and action of those latter cylinders is also changed over.

Change speed clutch 56 is reset so that the gripper cylinders 40,42 run without the above 25% slow-down i.e. at the 6:3 ratio to rotation of the main jaw cylinder 32, so timing relative rotation that each of the three d.p. jaws 60*a*, *b* and *c* coact in turn with respective tuck blades 62 of cylinder 32. At the same time the cams of cylinders 40 and 42 are set to keep take-off grippers 44 in their closed inoperative position while bringing d.p. jaws 60 into operation.

In this way each folded signature 28*a* carried on main jaw cylinder 32 is both further folded and transferred to one or other of the gripper cylinders by a blade 62 tucking its central region into a respective set of d.p. jaws 60 instead of its leading edge being engaged by one of the two sets of take off grippers 44.

Figure 4:
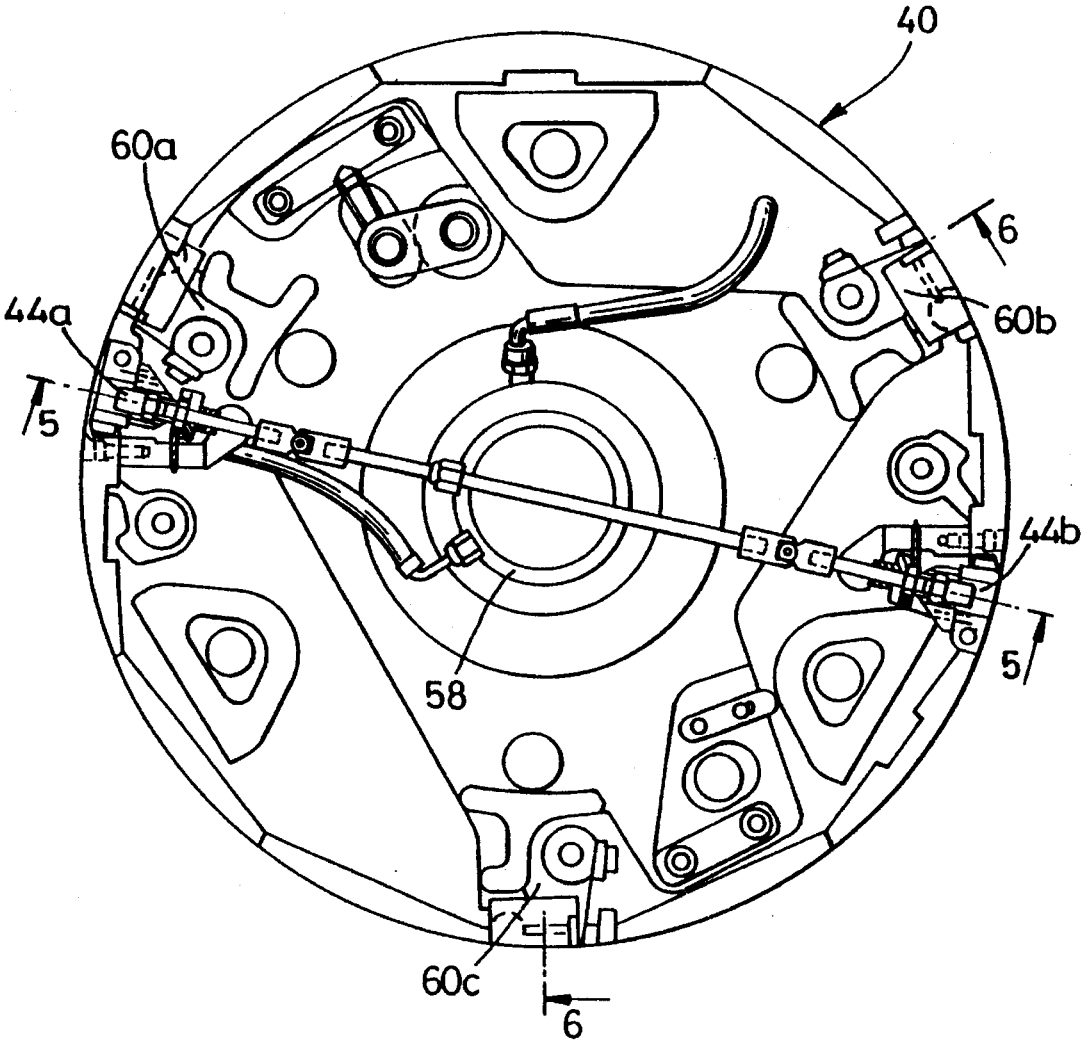
FIG. 4 is a more detailed and elevation of the latter cylinder.
Figure 5:
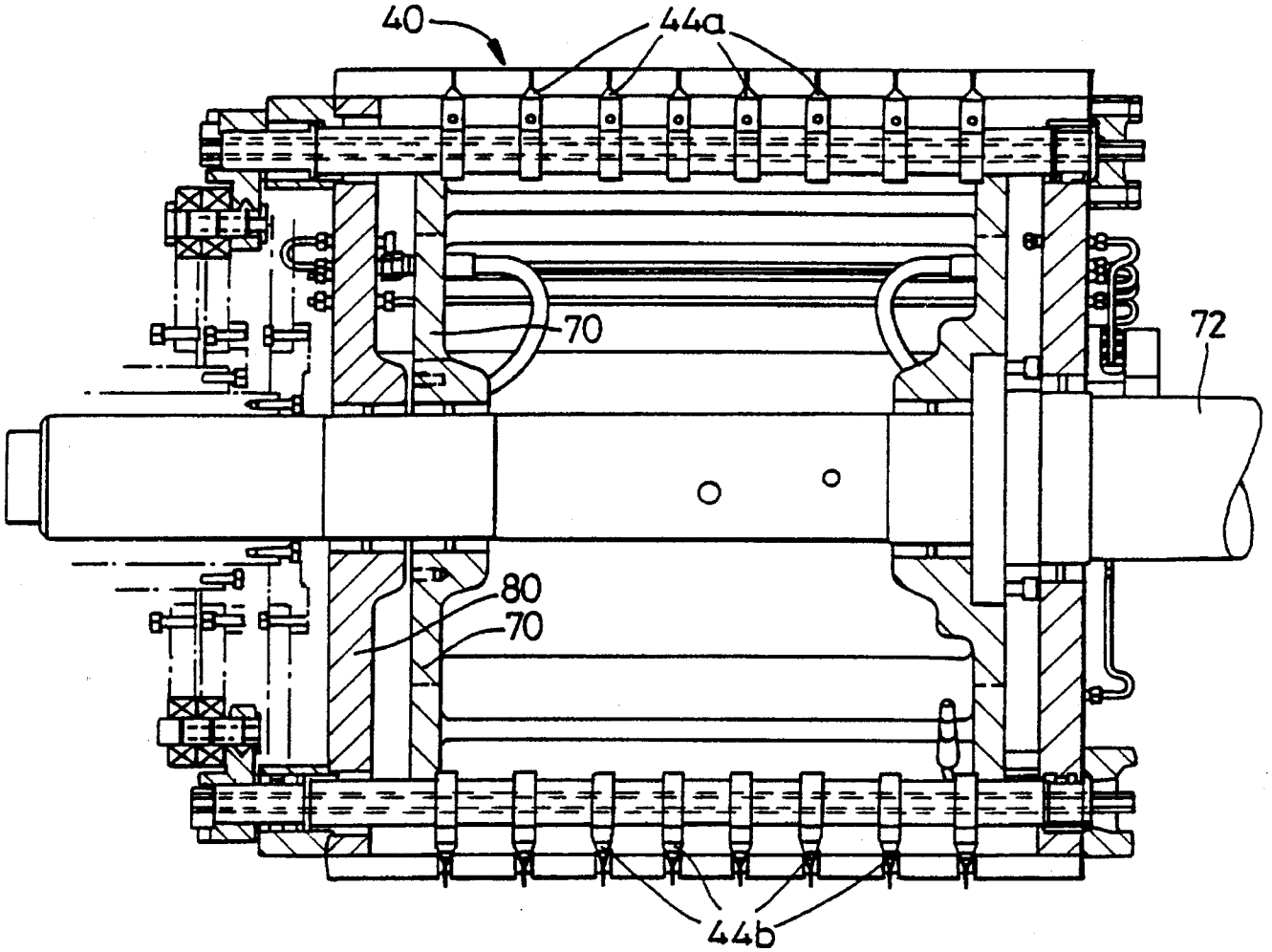
FIG. 5 is an axial section on line 5—5 of FIG. 4.
Figure 6:
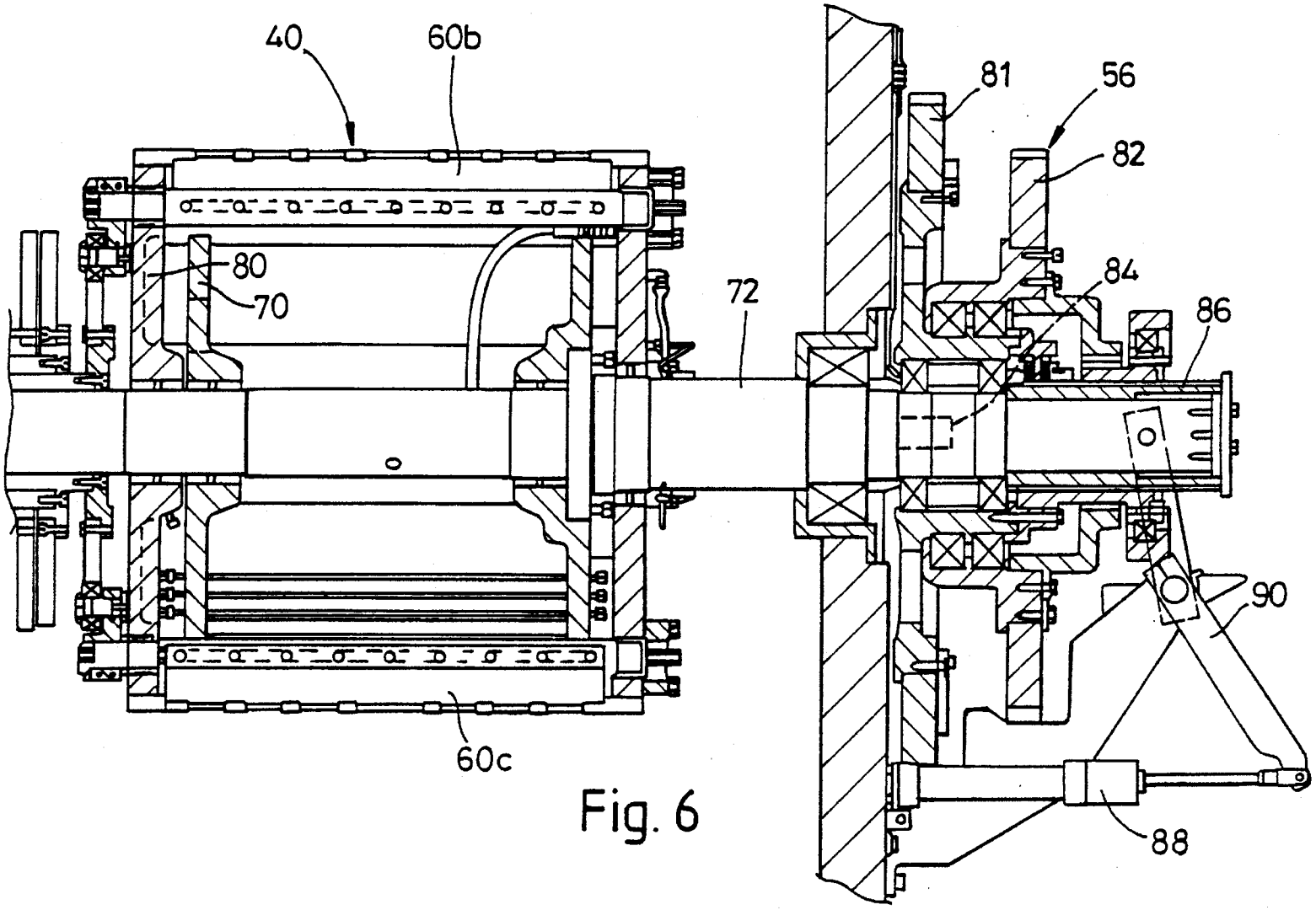
FIG. 6 is a like axial section but on line 6—6 of FIG. 4 and further including a variable speed drive clutch of the gripper cylinder.

One of the two identical gripper cylinders 40 and its associated change speed clutch 56 are shown in greater detail in FIGS. 4, 5 and 6. The cylinder comprises a first spider 70 (FIG. 5) mounted on the cylinder shaft 72 and carrying the two sets of diametrically opposed take-off grippers 44*a*, 44*b*, each set being eight in number across the cylinder periphery. The cylinder shaft 72 runs in ball bearings and these and other items including cam followers are automatically lubricated from a centralised grease lubrication system.

Grippers 44 are cam operated from the front end of the cylinder, clamping of the tabloid signatures for take off being effected against polyurethane pads mounted in anvil bars of the grippers sets. Preloaded torsion springs maintain the cam followers in contact with the operating cams. A hardened and ground plate cam of each gripper cylinder controls take off from main cylinder 32 and each plate cam is manually adjustable on the run from the outside of the folder for timing purposes.

The anvils can be gang adjusted to suit different copy thicknesses using an anvil gang adjuster at the centre of each anvil. Gang adjustment is achieved by way of either of the two anvils, this adjustment has to be made manually with the folder stationary. Each complete gripper cylinder 40 is dynamically balanced for high operating speeds.

Additionally a three arm spider 80 of cylinder 40 contains the three sets of cam operated d.p. jaws 60 (FIG. 6), a further hardened and ground plate cam controls the double parallel tucking take from main jaw cylinder 32 in conjunction with operation of the tucking blade 62 of the latter as referred to above. Each double parallel take cam is manually adjustable on the run for timing purposes. The double parallel jaw anvils and blades are coated with suitable material for wear resistance and maximum copy grip. All three g.p. jaws 60 of the cylinder can be manually adjusted together to suit different copy thicknesses using an appropriate gang jaw adjuster with the folder stationary. The take-off grippers are automatically held inactive during product changeover to double parallel by repositioning a blanking cam.

Change speed clutch 56 is carried on shaft 72 and comprises a larger, i.e. lower ratio tabloid drive gear wheel 81 and a smaller, i.e. higher ratio double parallel drive gear wheel 82 each free to rotate relative to the shaft and to each other. Both gear wheels are in constant mesh with the drive gear train (not shown) of apparatus 10. A drive dog 84 carried on a sleeve 86 in driving engagement with but axially displaceable on shaft 58 can be selectively positioned to engage one or other of the two gear wheels 81, 82 to select the appropriate drive ratio, the shifting being effected by an actuating ram 88 and lever 90.

It will be appreciated that other forms of variable ratio drive mechanism could be employed instead of the above described dog clutch arrangement.

Changeover between different modes and setting and monitoring the operation of folding apparatus 10 is preferably effected by a control system incorporating appropriate software for minimum manpower requirements and a high level of automation. The software includes quick access menus for makeready, on run and status functions and for memorising settings for different types and combinations of operations for speedy recall and reuse, as well as allowing pre-setting of web width and other parameters.

Changeover between different formats, e.g. between tabloid, quarter page and/or double parallel signature output is completely automated and can be completed within about five minutes reducing plant downtime to a minimum and again providing high efficiency operation.

What we claim is:

1. Continuous web-fed folding apparatus including:

a) means for severing the web to form a stream of successive discrete signatures;

b) a first rotary cylinder having a periphery formed to carry said stream from said means for severing and having at least one first tucking element selectively operable to project transversely of said periphery in timed relationship to rotation of said cylinder, c) a second rotary cylinder alongside said first cylinder and having at least one first peripheral jaw means selectively operable to open and close in timed relationship to rotation of said second cylinder;

d) means for driving said means for severing, and said first and second cylinders synchronously whereby said first tucking element coacts with said first jaw means to insert an intermediate part of a signature carried on the first cylinder periphery in use into said first jaw means for engagement thereby so transversely folding said signature while transferring it to the second cylinder; and e) at least one third rotary cylinder alongside said second cylinder, said means for driving also driving said third cylinder synchronously with the second cylinder, said third cylinder including at least one peripheral gripper means selectively operable to open and close in timed relationship to rotation of said third cylinder whereby said gripper means engages and takes successive signatures off the second cylinder for downstream delivery;

wherein the improvement comprises f) said second cylinder further including at least one second tucking element selectively operable to project transversely of the second cylinder periphery in timed relationship to rotation of that cylinder; and g) said third cylinder including at least one second peripheral jaw means selectively operable to open and close in timed relationship to rotation of said third cylinder with said means for driving set to bring said second jaw means into coacting relationship with said second tucking element in a second fold mode whereby an intermediate part of a signature previously folded by the first tucking means and carried on the second cylinder is inserted into said second jaw means to further transversely fold said signature while transferring it to the third cylinder, wherein the second cylinder includes a plurality of angularly spaced sequentially operated first jaw means and the equivalent number of angularly spaced sequentially operable second tucking elements for acting on a plurality of signatures while carried by said second cylinder, wherein the third cylinder includes a plurality of angularly spaced sequentially operable gripper means, a plurality of angularly spaced sequentially operable second jaw means, and drive input means which can be selectively set to bring said plurality of gripper means or said plurality of second jaw means into synchronization with operation of the second cylinder for selection or de-selection of said second fold mode.

2. Apparatus as in claim 1 wherein the third cylinder has two gripper means angularly spaced at diametrally opposite peripheral locations 180° apart, and three second jaw means angularly spaced 120° apart from each other and also angularly spaced from said gripper locations.

3. Apparatus as in claim 2 wherein said drive input means of the third cylinder provides a first drive ratio related to the peripheral speed of the second cylinder to bring said two gripper means into successive engagement with respective signatures carried on the second cylinder, and a second drive ratio related to said speed to bring said three second jaw means into successive coaction with respective said second tucking elements of the second cylinder.

4. Apparatus as in claim 3 wherein the drive input means includes first and second gear wheels relatively rotatable on a shaft carrying the third cylinder and respectively sized to provide said first and second drive ratios, a gear train operatively driving both said gear wheels, and clutch means selectively operable to connect one or other of said gear wheels in driving engagement with said shaft.

5. Apparatus as in claim 4 including two said third cylinders alongside respective angularly spaced zones of the second cylinder periphery whereby signatures pass from the latter periphery in two separate streams, each said third cylinder acting on alternate signatures in the stream carried round the second cylinder periphery in use.

* * * * *